United States Patent [19]

Kollberg

[11] 4,183,395

[45] Jan. 15, 1980

[54] MULTI-PHASE STIRRER

[75] Inventor: Sten Kollberg, Vesteras, Sweden

[73] Assignee: Asea Aktiebolag, Vesteras, Sweden

[21] Appl. No.: 873,787

[22] Filed: Jan. 31, 1978

[30] Foreign Application Priority Data

Feb. 3, 1977 [SE] Sweden ..... 7701157
Mar. 25, 1977 [SE] Sweden ..... 7703421

[51] Int. Cl.[2] ..... B22D 27/02
[52] U.S. Cl. ..... 164/147; 164/49
[58] Field of Search ..... 164/48, 49, 146, 147, 164/250; 266/233, 234; 219/10.75, 10.79

[56] References Cited

U.S. PATENT DOCUMENTS

| | | | |
|---|---|---|---|
| 2,310,501 | 2/1943 | Waldvogel | 310/256 |
| 2,761,082 | 8/1956 | Chang | 310/187 |
| 2,802,123 | 8/1957 | Tweedy et al. | 310/187 |
| 2,944,309 | 7/1960 | Schaaber | 164/147 |
| 3,693,697 | 9/1972 | Tzavaras | 164/147 |
| 3,731,127 | 5/1973 | Harrington | 310/256 |
| 3,886,387 | 5/1975 | Graham et al. | 310/256 |
| 3,911,997 | 10/1975 | Sugazawa et al. | 164/49 |
| 4,016,926 | 4/1977 | Yamada et al. | 164/49 |

*Primary Examiner*—Robert D. Baldwin
*Assistant Examiner*—K. Y. Lin
*Attorney, Agent, or Firm*—Watson, Cole, Grindle & Waston

[57] ABSTRACT

A multi-phase stirrer for stirring the molten cores of cast slabs from continuous casting machines is divided into at least two partial stirrers with each partial stirrer comprising at least one phase winding and fed with a number of phases at least one less than the total number of phases of the stirrer apparatus. Each partial stirrer may be arranged at different sides of the cast slab to form a rotary field around the cast slab in association with the other partial stirrers. Additional iron cores may be arranged in the air gaps formed between the iron cores of the respective partial stirrers. Alternatively, the additional iron cores may be arranged within the support tubes of the casting apparatus.

10 Claims, 9 Drawing Figures

MULTI-PHASE STIRRER

BACKGROUND OF THE INVENTION

1. Field of the Invention

The present invention relates to a multi-phase stirrer for stirring the molten core around or along a cast string or slab coming from a continuous casting machine and arranged around or along the cast slab.

2. Prior Art

Stirring of a cast slab can be achieved by accelerating the melt along or across the cast slab, and also, of course, at any angle between these directions. Normally, a straight stirrer is used or the melt is accelerated by a rotating field using a round stirrer of the motor stator type.

In a continuous casting machine molten metal is poured into a water-cooled mold, the solidified slab being drawn out downwards through the mold. When the slab leaves the mold, it consists of a thinly solidified shell and a liquid core. After the cast slab has left the mold, it is normally sprayed with water in a secondary cooling zone, the solidifying shell then increasing in thickness until the whole cast slab has solidified. During the solidification process, it is desirable for the still liquid core to be stirred, since this, among other things, counteracts segregation phenomena and formation of cracks, as well as formations of large pores and voids, and among other things so-called pipes.

A known device for achieving stirring is a so-called round stirrer, in which the melt is rotated around the center line of the slab in a plane perpendicular to the withdrawing or transportation direction of the slab. This rotation is effected by a rotary magnetic field in the same plane. The round stirrer is often designed in principle as a two-pole, three-phase motor stator through which the slab passes.

However, the continuous casting machine is often mechanically built up from a framework of tubes. Normally, support rolls are attached in these tubes and control the slab. The tubes and support rolls are mechanically divided into a number of segments which are exchanged and replaced by spare segments during maintenance. This procedure considerably facilitates the mechanical maintenance, but the framework constitutes an obstacle to the location of the stirrers for the stirring purpose just mentioned.

The round stirrer can be positioned either between the tubes of the machine and the slab, or in such a way that it surrounds both the tubes and the slab. In the firstmentioned case the stirrer has to be very small and it will also be located so close to the slab that this will make water-cooling difficult.

In the second case, the stirrer has to be positioned so far from the slab that its effect is strongly reduced. In both cases problems will arise when the segment, where the stirrer is placed, is to be replaced. These types of stirrers are also difficult to adjust to different cross-sectional dimensions of the slab, and still more difficult to adjust to slabs with non-square cross-sections.

SUMMARY OF THE INVENTION

The invention provides a solution to the abovementioned problems and other problems associated therewith, by using at least one stirrer of a straight type with each stirrer being divided into two or more partial stirrers, each partial stirrer comprising at least one phase winding, and supplied with current of a number of phases at least one less than the total number of phases of the stirrer. Each partial stirrer is arranged at different sides and different longitudinal portions, respectively, of the cast slab, and together with the other partial stirrers, to achieve a rotary or longitudinal field, respectively, around or along the cast slab, respectively. In this way a rotating flux can be achieved in the melt in one case and, by letting the partial stirrers cooperate, a rotary magnetic flux will be achieved, similar to that achieved from a round, two-pole stirrer. The partial stirrers can be positioned so that the exchanges of sections can be done easily and so that the stirring effect is good. The rotation of the melt thus obtained means that the drawbacks in connection with continuous casting are avoided.

In one of the main modifications of the invention the stirrers are of straight type and each is divided into two or more partial stirrers, each comprising at least one phase winding and arranged together with at least one more partial stirrer to achieve a travelling field along the cast slab. In this way the principle of the invention can be utilized also in the longitudinal direction along the cast slab, resulting in a simplified construction with exchangeability for the various sections. It is thus possible to achieve stirring in a continuous casting machine in spite of the fact that the space for constructing stirrers is very limited, which means that the number of turns in the windings, the pole pitch, etc., can be chosen with regard to the space available.

BRIEF DESCRIPTION OF THE FIGURES

The invention is exemplified in more detail in the accompanying drawings, wherein.

DETAILED DESCRIPTION

The stirrer described in the present application will eliminate the above-mentioned disadvantages. It may consist of a three-phase stirrer or a two-phase straight stirrer, which has been divided into four so-called partial stirrers, as shown by FIGS. 1 and 2.

Figure 1:
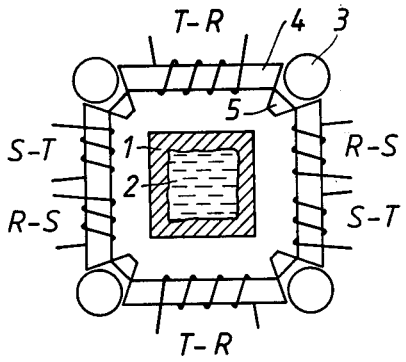
FIGS. 1 and 2 show two different modes of stirring in connection with a square cast slab using two or more partial stirrers.

FIG. 1 shows continuously cast object 1 with non-solidified part 2 which is to be stirred with a stirrer according to the invention. The stirrers consist of partial stirrers, T-R, R-S and S-T, T-R and R-S and S-T. The designations R, S and T indicate the three phases of a three-phase system. The stirrer R-S and S-T, that is with two windings on the iron core, in this case cooperate, for example, with partial stirrer T-R which has a winding around iron core 4. The described partial stirrers consist of laminated iron core 4, around which the different coils are placed, and as can be seen the partial stirrers positioned at the side in the Figure are each provided with two coils, whereas the upper and the lower partial stirrer in the Figure are provided with one coil. The partial stirrers can be coil-wound as shown in FIGS. 1 and 2, or with overlapping winding (the winding placed in slots). The partial stirrers may, of course, be provided in the usual manner with damping plates 6 (see FIG. 2) for preventing a leakage flux backwards, counting from the stirrers. Tubes 3 support the casting machine and laminated iron cores 5 (FIGS. 1 and 3) are placed between the partial stirrers and their respective iron cores 4, for obtaining a closed magnetic circuit and to conduct the magnetic flux past support tubes 3.

Figure 3:
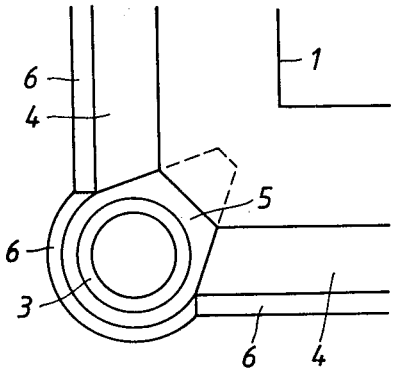
FIG. 3 shows a device in a tube for a casting machine.

The air gap between the partial stirrers causes losses and it may therefore be advantageous to fill this air gap with magnetic conductor 5 which is shown in FIGS. 1 and 3. Conductor 5 can then also be formed as a slot tooth towards the string, as shown in FIG. 1. Magnetic conductor 5 can also be constructed as a ring which surrounds support tubes 3 and simultaneously provides fastening points for mounting the partial stirrers, as shown in FIG. 3.

Figure 2:
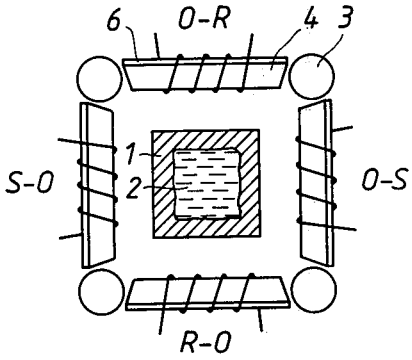

FIG. 2 shows four partial stirrers R-O, S-O, O-R and O-S, where O is the neutral, all partial stirrers thus cooperating as one whole stirrer. Damping plates 6 are clearly shown in FIG. 2. The stirrer according to FIG. 1 is a three-phase stirrer and the stirrer according to FIG. 2 is a two-phase stirrer.

FIG. 3 shows, as mentioned, support tube 3 with the laminated, or otherwise formed, iron core between the partial stirrers, the cores of which are shown at 4. Damping plate 6 also comprises the laminated iron core 5 at the support tube 3. In this way, a closed magnetic circuit is formed.

Figure 4:
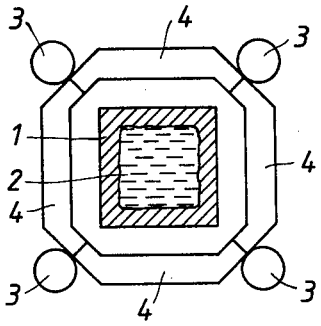
FIG. 4 shows an alternative embodiment of the invention with the iron core inside the support tubes.

FIG. 4 shows iron cores 4 for the different partial stirrers, arranged around the cast string 1 with its non-solidified part 2. The iron cores are bevelled so that they can be placed inside support tubes 3.

Figure 5:
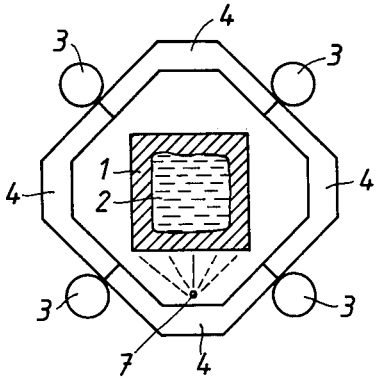
FIG. 5 is a variant of FIG. 4.

FIG. 5 is a modification of FIG. 4, in which iron cores 4 for the partial stirrers are bent and in which support tubes 3 are placed outside the joints between the iron cores, the joints as usual consisting of small air gaps. A sprinkler for coolant is shown at 7, and is arranged to cool the cast string. More than one sprinkler can of course be used.

Laminated core 4 in each of the partial stirrers can also be constructed so that practically no air gap remains between the partial stirrers (see for example, FIG. 4). The partial stirrers can also be constructed with regard to the fact that the secondary cooling should be disturbed as little as possible (for example, in accordance with the embodiment of FIG. 5).

A stirrer with too great stirring force causes so-called "white bands" in the solidified slab. It may therefore be advantageous to distribute the stirring effect along a longer part of the slab. Several other factors also favor such a distribution.

Figure 9:
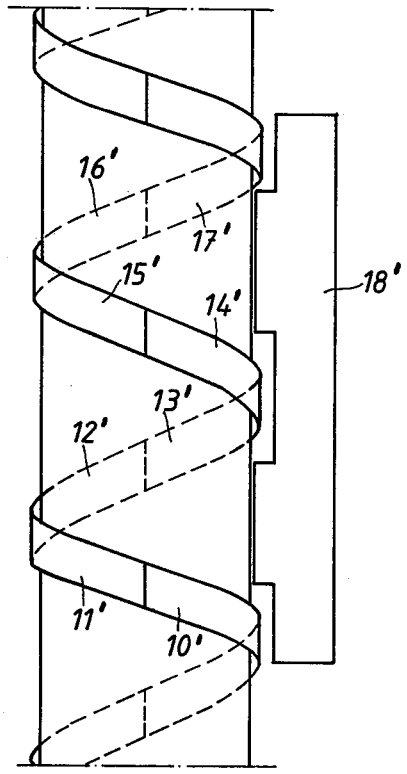
FIG. 9 is a modified embodiment showing helically arranged partial stirrers mounted along the longitudinal axis of a continuously cast slab.

If a large number of partial stirrers ($\geqq 4$) are mounted at a certain angle ($\neq 90°$) with the direction of movement of the slab, but still so that a magnetic closed circuit is formed by all partial stirrers, these partial stirrers will form a helical force field along the slab. This means that the magnetic field in the slab will rotate while at the same time it is moved with or against the direction of movement of the slab. This causes the molten portion of the core to move in a corkscrew-like movement. In this way it is possible to distribute the effect from several "plane" stirrers over a larger distance of the slab and, among other things, partly avoid "white bands". Such an arrangement is shown in FIG. 9 wherein a series of helically arranged partial stirrers 10', 11', 12', 13', 14', 15', 16', 17' are mounted about the longitudinal axis of a continuously cast slab. Iron core 18' closes the reluctance path of the magnetic circuit formed by partial stirrers 10'–17'.

Several different stirrers placed at different distances from the mold and with a power development which has been adapted to the shell thickness of the slab at the positioning in question can also lead to the desired distribution of the stirring effect.

Compared with the normal round stirrer of the stator type, the described stirrer presents the following advantages: The size of the iron core and the number of turns in the windings can be chosen more freely; the mechanical mounting in the continuous casting machine is considerably facilitated; the stirrer can be simply adapted to different cross-sections of the slab by moving the partial stirrers; the stirrer can be adapted to slabs with non-square cross-section; the air gap between the partial stirrers can be provided with a magnetic conductor (laminated iron core) which can also be formed as a slotted tooth, which does not disturb the water sprinkling against the plane surfaces of the slab; and the power effect can be "distributed" along the slab by means of the abovementioned "helical stirrer".

Figure 6:
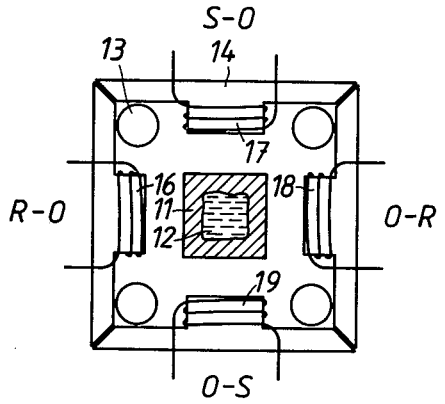
FIGS. 6 and 7 are other modifications of the invention.

The embodiment according to FIG. 6 consists of a two or three-phase stirrer which has been divided into partial stirrers R-O, S-O, O-R, O-S around iron cores 14 arranged around cast slab 11 with partly non-solidified melt 12. The partial stirrers can be positioned around support tubes 13 in a casting machine. The partial stirrers include one or two windings from one or two phases, respectively, and thus do not by themselves give rise to any stirring effect. Only cooperation between several stirrers provides the desired result. The resulting flux is, of course, the same as is obtained from a common two-pole motor stator with salient poles, for example one that is to be found in synchronous or asynchronous machines. As can be seen, windings 16, 17, 18, 19 are positioned adjacent salient poles of iron core 14. The partial stirrers comprise laminated iron cores with salient poles, and one to two windings.

Figure 7:
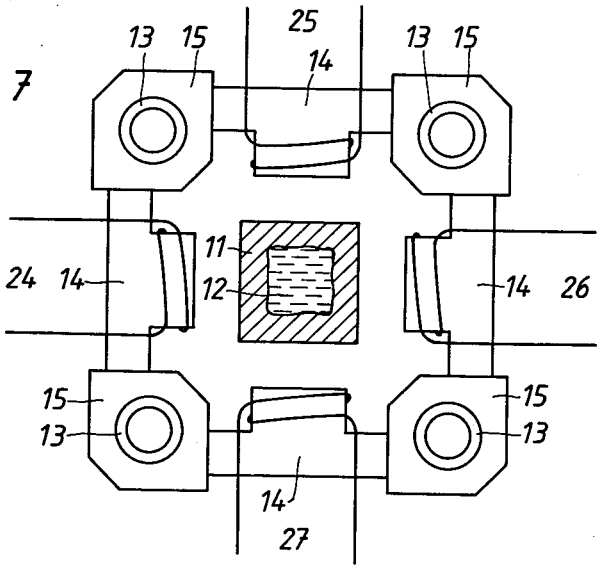

FIG. 7 shows a special embodiment of the invention, arranged at the side of support tubes 13 of the casting machine. Magnetic conductors 15 are arranged around support tubes 13 and between the tubes are arranged iron cores 14 for the different partial stirrers 24, 25, 26 and 27. Each of the partial stirrers is displaceable to and from cast slab 11 for the purpose of adjusting a suitable flow and a suitable penetration depth.

The air gap between the partial stirrers sometimes causes losses. It may, therefore, be advantageous to fill up this air gap by magnetic conductor 15, which is also shown in FIG. 7. The device can also be constructed so that a fixed attachment for the partial stirrers is arranged at support tubes 13. The partial stirrers can also be designed so that there is practically no air gap between them (as for example, shown in FIG. 6).

To distribute the stirring effect, several partial stirrers, for example more than four, can be positioned in a known manner so as to form a helix along the cast slab. Several partial stirrers at varying distances from the mold may also give the desired result, particularly if the stirring force is adjusted to the shell thickness for the positioning in question.

Figure 8:
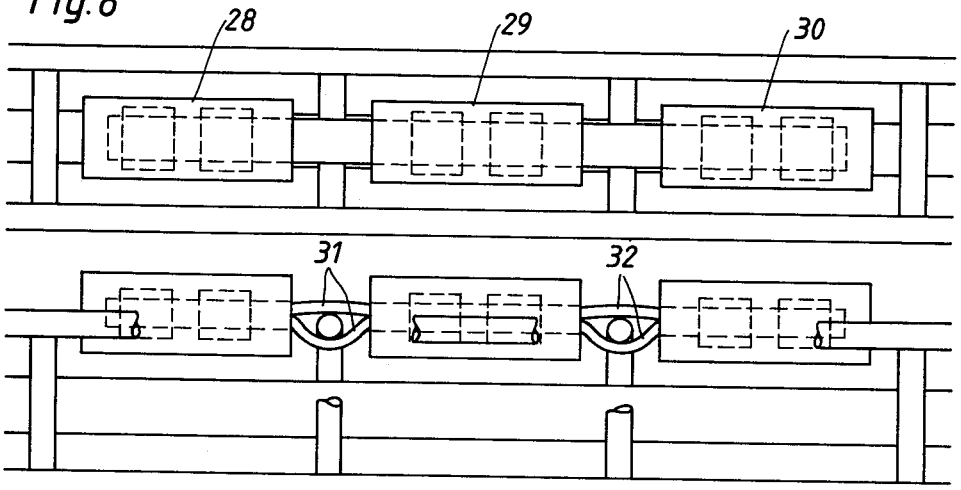
FIG. 8 is an embodiment for longitudinal stirring.

FIG. 8 shows a division of a straight stirrer into a number of partial stirrers 28, 29, 30 wherein the disadvantages of arranging constructions within a limited space are partially removed. These partial stirrers may comprise one to three windings which by themselves do not result in any stirring effect, or give poor stirring effect. If the different partial stirrers 28–30 are coupled together magnetically, a complete stirrer with normal stirring effect is obtained, that is, a travelling field can be obtained along the cast slab with or against the direction of casting depending on how the partial stirrers are mutually coupled. A completely normal stirrer with normal stirring effect is thus obtained according to this embodiment. With this division into partial stirrers a distribution of the stirring effect is also obtained, which is an advantage.

The stirrer can also be completed in such a way that magnetic conductors 31, 32 are placed between them, which improves the stirring effect.

What is claimed is:

1. A multi-phase stirrer for stirring the molten core of a cast slab from a continuous casting machine, said stirrer being divided into at least two partial stirrers with air gaps therebetween, each said partial stirrer including an iron core and being mounted together with the other partial stirrers to form the multi-phase stirrer with a magnetic circuit around the cast slab in which the iron cores of the partial stirrers are included, each said partial stirrer comprising at least one phase winding and fed with a number of phases at least one less than the total number of phases of the stirrer, each partial stirrer being arranged at different sides of the cast slab, and together with the other partial stirrers forming a rotary field around the cast slab, and additional iron cores arranged in the air gaps between said iron cores.

2. A multi-phase stirrer for stirring the molten core of a cast slab from a continuous casting machine, said stirrer being divided into at least two partial stirrers with air gaps therebetween, each said partial stirrer including an iron core and being mounted together with the other partial stirrers to form the multi-phase complete stirrer with a magnetic circuit around the cast slab in which the iron cores of the partial stirrers are included to form the iron core of the complete stirrer, each partial stirrer comprising at least one phase winding and fed with a number of phases at least one less than the total number of phases of the stirrer, each partial stirrer being arranged at different longitudinal portions of the cast slab, and together with the other partial stirrers forming a longitudinal field along the cast slab, and additional iron cores arranged in the air gaps between said iron cores.

3. Stirrer according to claim 1, wherein the number of partial stirrers is at least four, arranged in a helix one after the other around the cast slab, said partial stirrers each including an iron core arranged to form together a helical, magnetic circuit, a magnetic flux thus being obtained having a component in the axial direction along the cast slab and a component transverse to the direction of movement of the cast slab.

4. Stirrer according to claim 1, wherein several stirrers, each composed of partial stirrers, are arranged at different distances from the mold at the beginning of the cast slab and fed with different phase power in dependence on the shell thickness of the respective stirrer.

5. Stirrer according to claim 1, wherein the apparatus for casting the cast slab includes support tubes and said additional iron cores are arranged at said support tubes.

6. Stirrer according to claim 1, wherein the apparatus for casting the cast slab includes support tubes and said additional iron cores are arranged so that space is reserved for the support tubes in the iron cores.

7. Stirrer according to claim 1, wherein at least one of said partial stirrers is joined by damping plates for screening a leakage field.

8. Stirrer according to claim 2, wherein each of the partial stirrers is arranged, together with at least one other partial stirrer, to achieve a travelling field along the cast slab.

9. Stirrer according to claim 8, wherein one or more magnetic conductors are arranged between the partial stirrers.

10. Stirrer according to claim 1 wherein the apparatus for casting the slab includes support tubes and said additional iron cores are arranged so that space is reserved for the support tubes adjacent the iron cores.

* * * * *